United States Patent [19]

Focke et al.

[11] Patent Number: 4,732,166

[45] Date of Patent: Mar. 22, 1988

[54] APPARATUS FOR TESTING CIGARETTES IN A CIGARETTE PACKAGING MACHINE AND FOR REMOVING DEFECTIVE CIGARETTES

[75] Inventors: Heinz Focke; Kurt Liedtke, both of Verden, Fed. Rep. of Germany

[73] Assignee: Focke & Co. (GmbH & Co.), Verden, Fed. Rep. of Germany

[21] Appl. No.: 723,415

[22] Filed: Apr. 15, 1985

[30] Foreign Application Priority Data

May 26, 1984 [DE] Fed. Rep. of Germany ..... 3419738

[51] Int. Cl.[4] ..... A24C 5/60

[52] U.S. Cl. ..... 131/283

[58] Field of Search ..... 131/94, 95, 96, 283

[56] References Cited

U.S. PATENT DOCUMENTS 2,216,447 10/1940 Meletti .
4,376,484 3/1983 Seragnoli .

FOREIGN PATENT DOCUMENTS 1121522 1/1962 Fed. Rep. of Germany ..... 131/96
1473435 4/1963 Fed. Rep. of Germany .
1246525 7/1963 Fed. Rep. of Germany .
1757932 6/1967 Fed. Rep. of Germany .
2044871 9/1969 Fed. Rep. of Germany .
2126031 12/1970 Fed. Rep. of Germany .
2223883 5/1972 Fed. Rep. of Germany .
2462551 5/1974 Fed. Rep. of Germany .
2918030 4/1979 Fed. Rep. of Germany .
3110927 3/1981 Fed. Rep. of Germany .
3316501 5/1983 Fed. Rep. of Germany .
2044457 3/1980 United Kingdom .
2073576 3/1981 United Kingdom .
2120526 5/1983 United Kingdom .

*Primary Examiner*—V. Millin
*Attorney, Agent, or Firm*—Sughrue, Mion, Zinn, Macpeak & Seas

[57] ABSTRACT

In the packaging of cigarettes and similar articles, it is necessary to test for proper formation, in particular for a sufficient tobacco content. This test is preferably carried out in the region of shafts 12 or shaft groups 15, 16 of a cigarette magazine 11. A test block 38 with test plungers 39 takes effect at one end of the cigarette (tobacco side). On the opposite side, grab members for each tested cigarette are provided, in particular needles 41 the points 42 of which penetrate into the cigarettes or into a filter 43 of the latter. The defective cigarettes are drawn out of the group by retracting the needles.

12 Claims, 9 Drawing Figures

Figure 1:
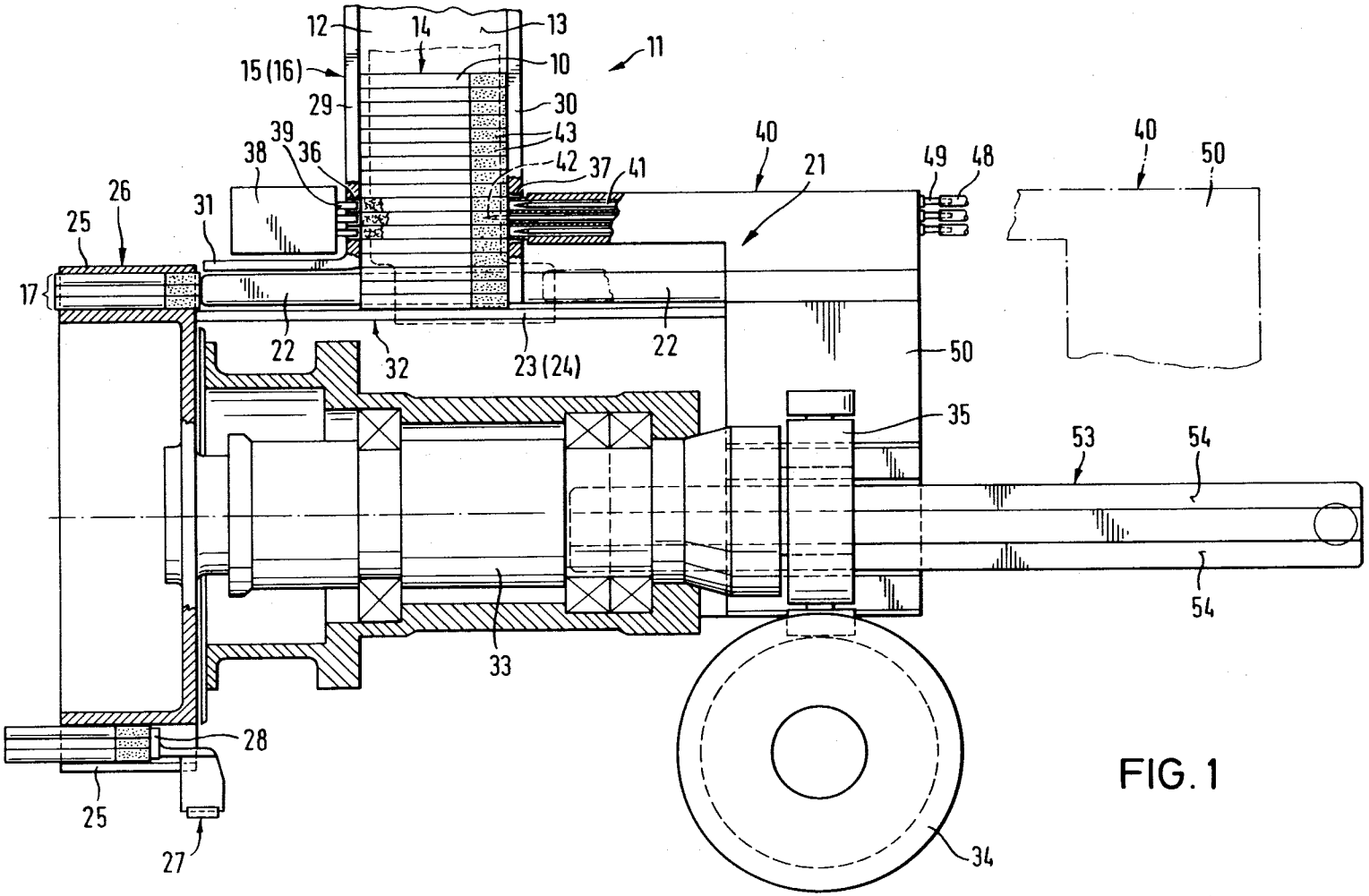

APPARATUS FOR TESTING CIGARETTES IN A CIGARETTE PACKAGING MACHINE AND FOR REMOVING DEFECTIVE CIGARETTES

DESCRIPTION

The invention relates to an apparatus for testing cigarettes for defects, especially for a sufficient tobacco content, in conjunction with cigarette packaging machines, defective cigarettes being separated out from the feed flow or from a formation of cigarettes.

As regards the packaging of cigarettes, the testing of cigarettes for defects, especially in respect of an insufficient tobacco content, is indispensable. Statistically, approximately every 200th cigarette is defective and has to be eliminated from further processing or packaging.

Cigarette testing is mainly carried out in the region of a conveyor for cigarette groups, for example in the region of a cigarette turret. This is equipped with pockets, each of which receives a number of cigarettes (cigarette group) corresponding to the finished cigarette pack. During a momentary standstill of the cigarette conveyor or of the cigarette group, the test is carried out by bringing a test head up to the free ends of the cigarettes. When a defective cigarette is identified, a control signal is triggered, and as a result of this the entire cigarette group or the cigarette pack is separated out as a defective pack in the subsequent feed flow. A single defective cigarette therefore means that a group of, for example, twenty cigarettes or more is separated out.

However, it is also already known to test cigarettes in the region of a cigarette magazine. This conventionally consists of a funnel-shaped storage container for receiving a plurality of cigarettes. In the lower region, a plurality of shafts combined into groups is connected to the magazine. The shafts partitioned off from one another by shaft walls each receive a vertical row of cigarettes arranged close to one another. At the bottom end of the shafts or shaft groups, a number of cigarettes corresponding to a cigarette pack is each time pushed out in the longitudinal direction of the cigarettes by plungers (fingers).

According to a known proposal, the cigarettes are tested in the region of the shafts, a test device being assigned to each shaft. In this case, defective cigarettes are intended to be separated out individually (German Offenlegungsschrift No. 3,110,927).

This known cigarette-testing device is designed so that each time only single-layer cigarette groups can be pushed out at the lower outlet end of the shafts of the cigarette magazine. Consequently, to form cigarette groups with several layers, a corresponding number of work cycles is required.

The object on which the invention is based is to propose a cigarette-testing apparatus of simple design and reliable mode of operation, in which the number of intact cigarettes to be separated out together with a defective cigarette is kept small, but cigarette groups ready for packaging can nevertheless be formed in one work cycle.

To achieve this object, the apparatus according to the invention is characterised in that the cigarette to be separated out can be grasped by a sharp or pointed grab member penetrating into a cigarette end, especially into a cigarette filter, and can be drawn out of the feed flow or the information.

Preferably, the grab member is designed as a pointed needle. To separate cigarettes out, this is inserted longitudinally into the cigarette filter via the free end face. Because of the nature of the cigarette filter, this adheres sufficiently to the needle as a result of friction, so that the particular cigarette can be taken out of the formation in the longitudinal direction by retracting the needle.

Preferably, a number of grab members (needles) corresponding to the number of cigarettes in a cigarette group for a cigarette pack is combined into a separating member and fed as a unit to a cigarette group. The needles are preferably received in channels or bores of a pull-off block. This is brought up to the end faces of the cigarettes on the filter side. Depending on the number and position of the defective cigarettes identified, needles are pushed in the axial direction out of the pull-off block and into the cigarette filter. The needles are at the same time appropriately subjected to air pressure.

According to a further proposal of the invention, testing and separating out of defective cigarettes are carried out in the region of a cigarette magazine, especially in the region of shafts of the latter. In this case, the pull-off block is brought up to the cigarettes via an orifice in a rear wall on one side of the shafts or a shaft group. On the opposite side (front wall), test plungers are moved against the end faces of the cigarettes on the tobacco side, in order to check that there is sufficient filling of tobacco. In the event of a defective cigarette, the particular plunger is moved in the axial direction, that is to say into the cigarette. A control signal causing the associated needle to be activated is generated thereby.

According to the invention, whenever there are defective cigarettes, several cigarettes resting on top of one another in a shaft or in a formation are separated out together with the defective ones. As regards cigarette groups with three layers on top of one another, the further cigarettes of the same cigarette group which are located in the same shaft are separated out together with the defective cigarette. It is thereby possible to guarantee that all the cigarettes in each shaft are tested.

Figure 2:
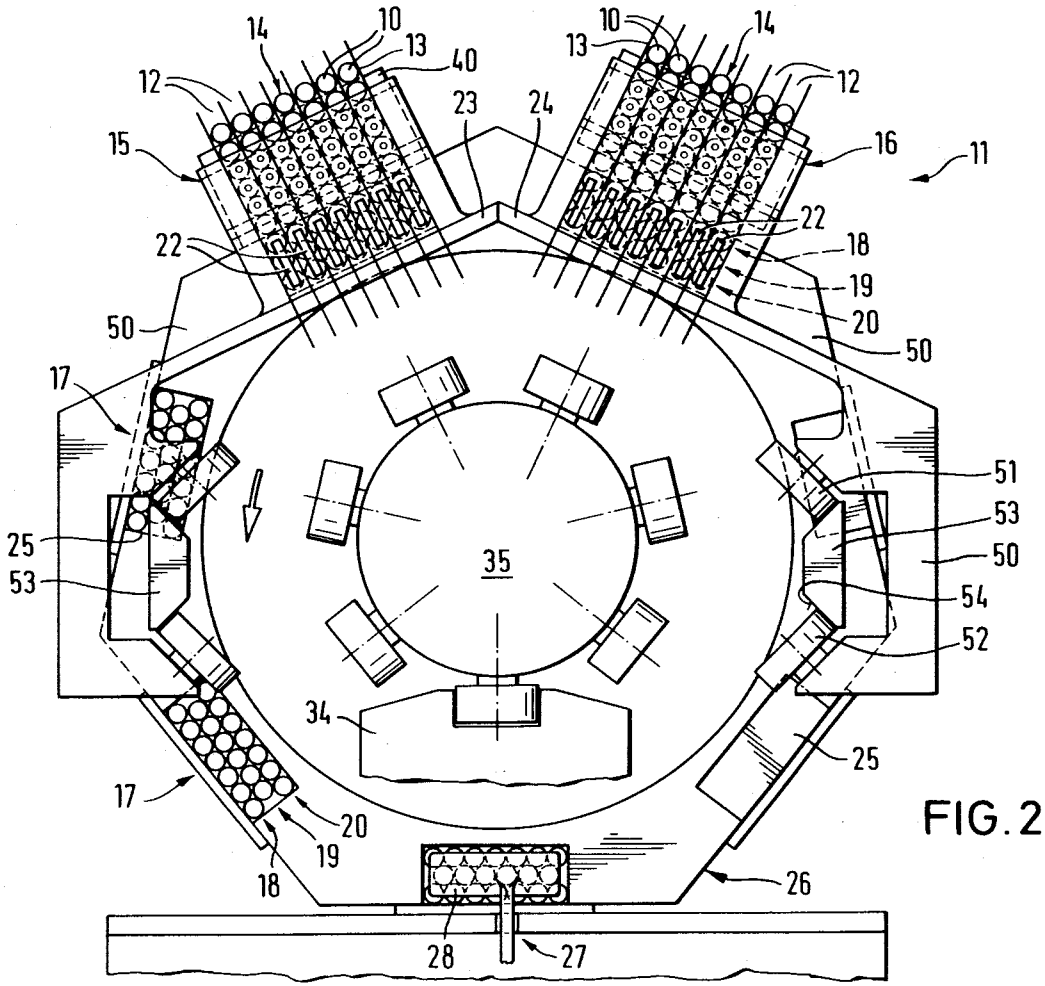
Figure 3:
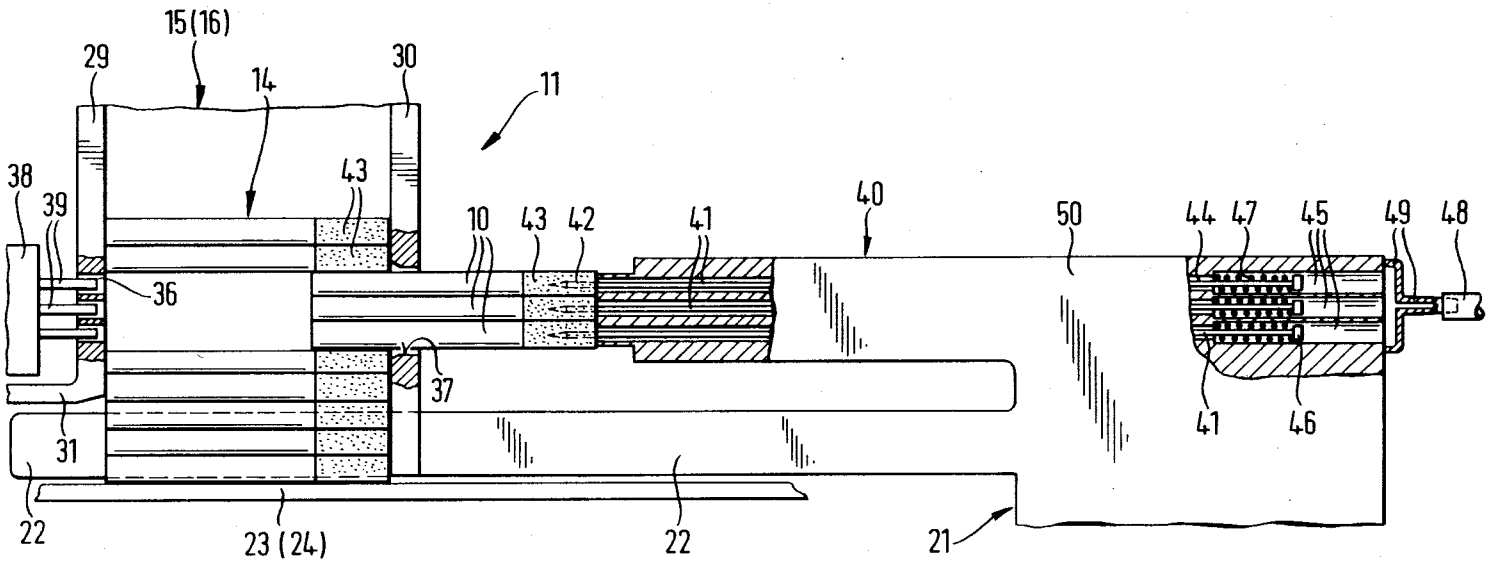
Figure 4:
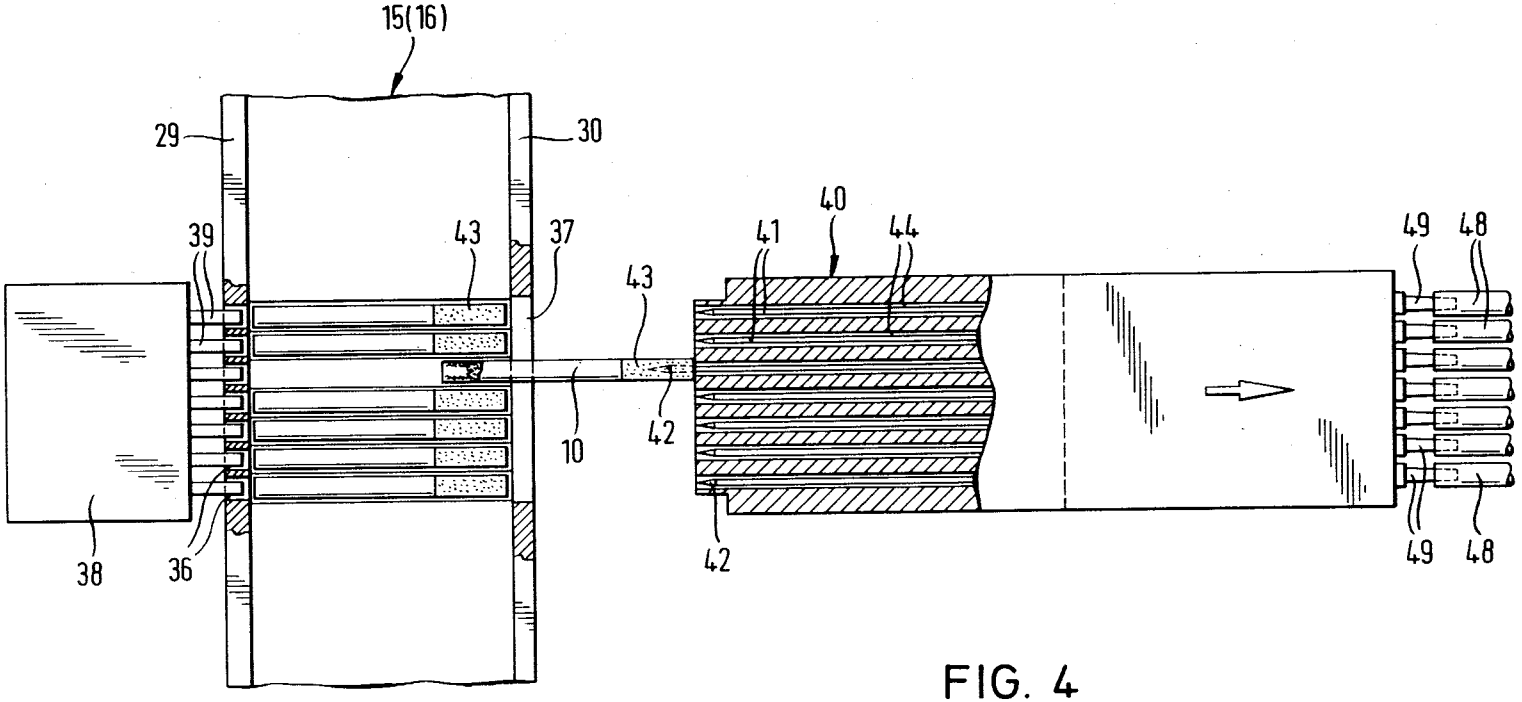
Figure 6:
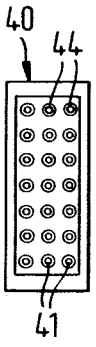
Figure 5:
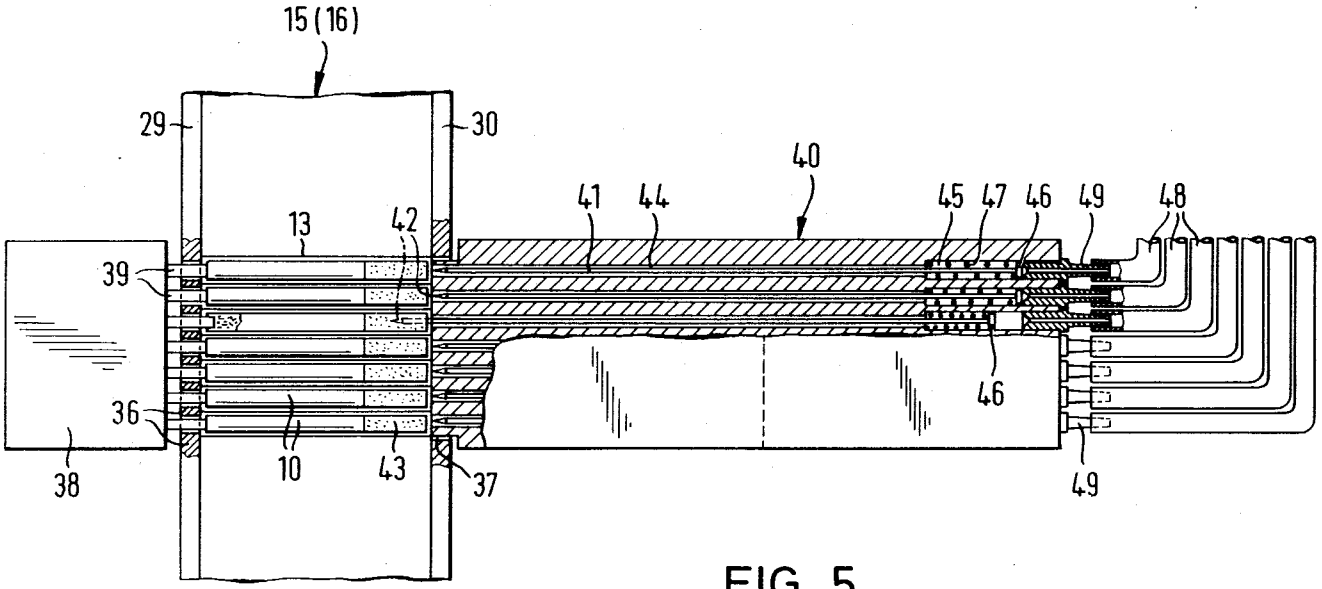
Figure 7:
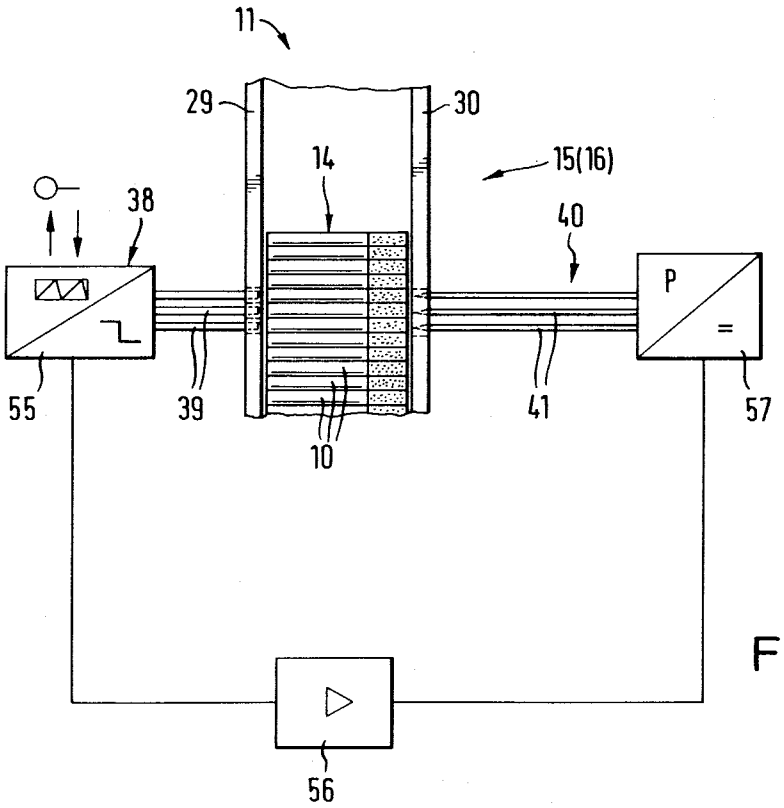
Figure 8:
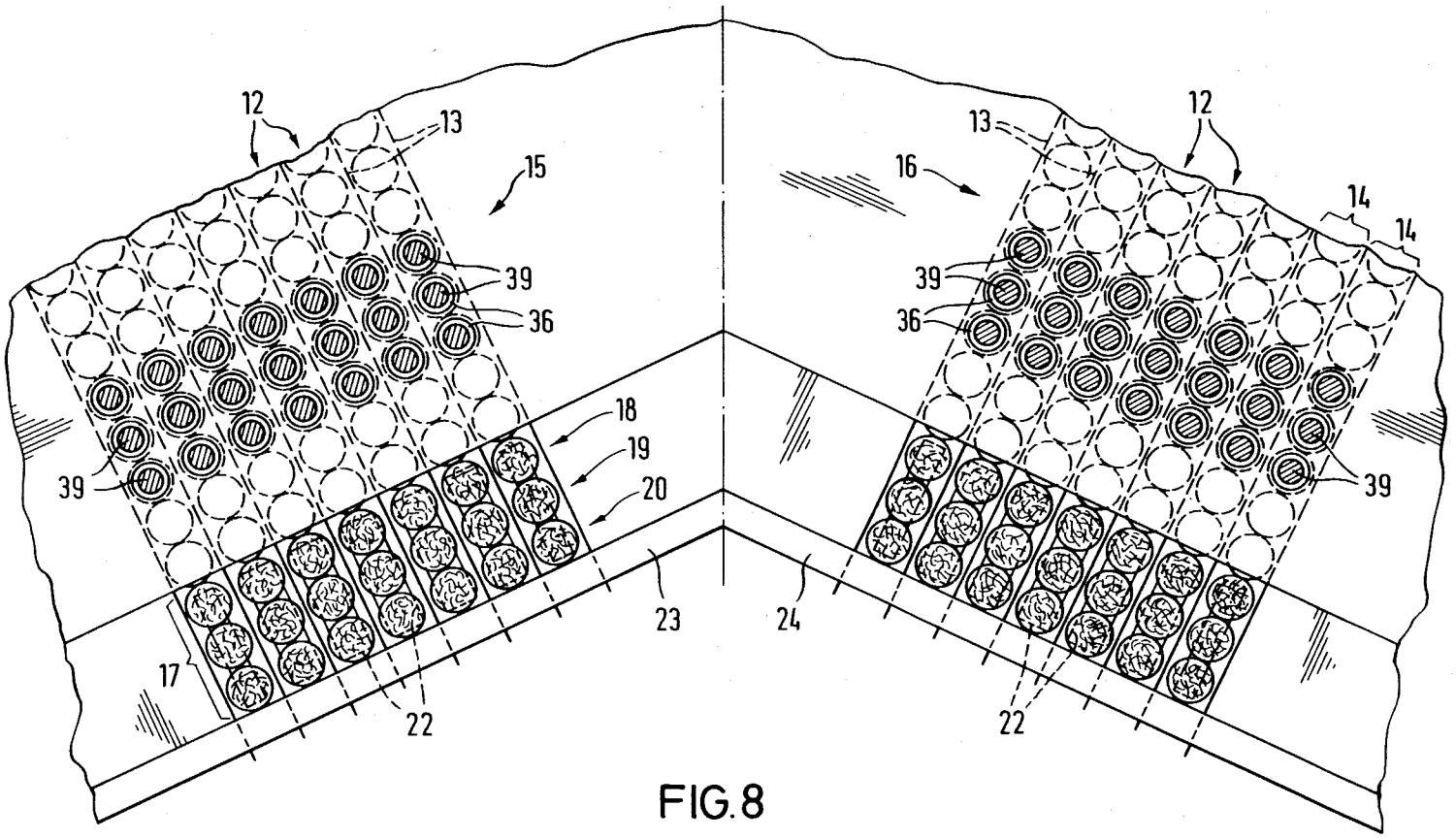
Figure 9:
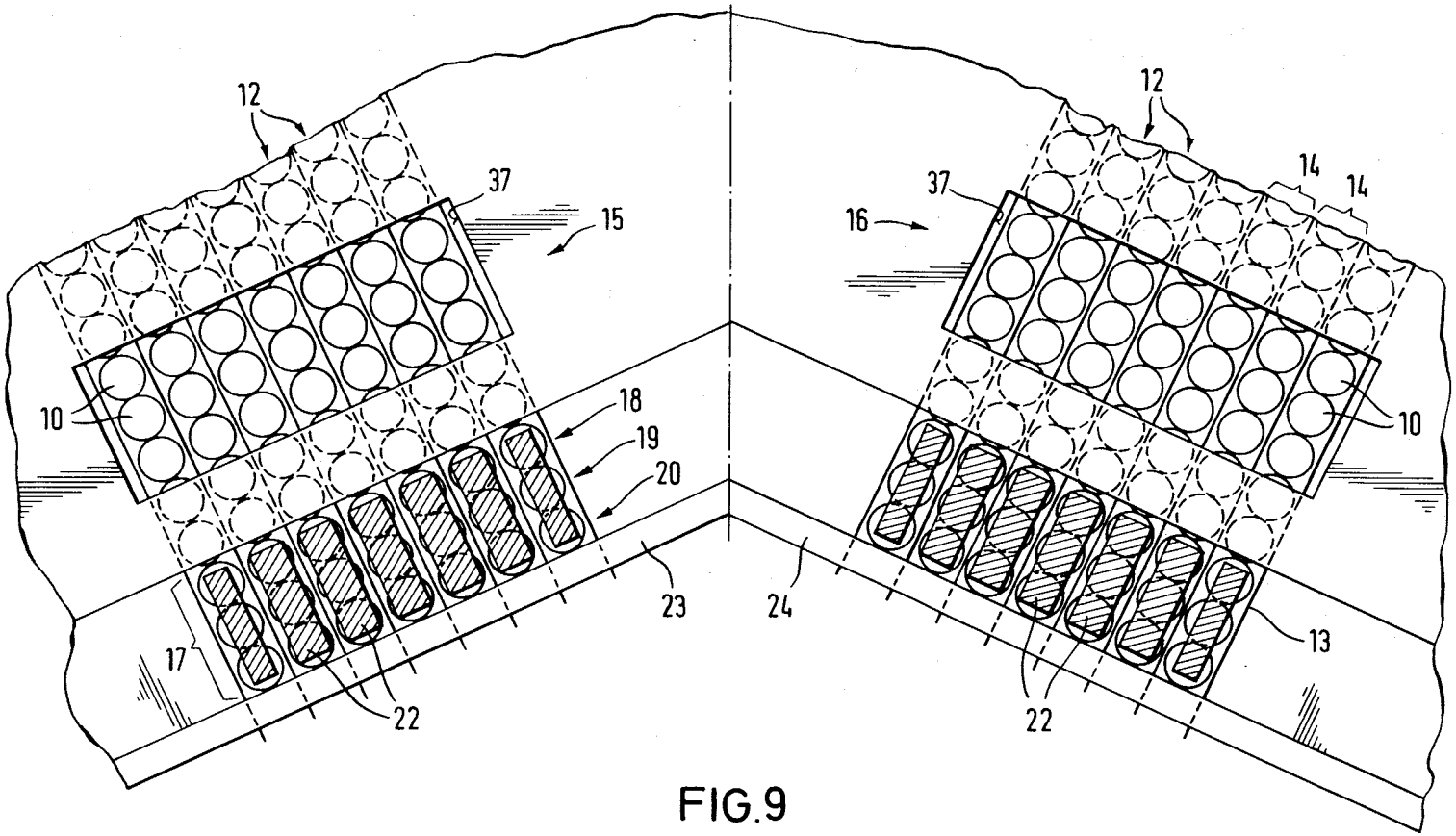

An exemplary embodiment of the invention is explained in more detail below with reference to the drawings in which:

FIG. 1 shows part of a cigarette packaging machine in a side view and in longitudinal section, FIG. 2 shows a rear view of the detail according to FIG. 1 on an enlarged scale, FIG. 3 shows a detail of the apparatus according to FIG. 1 on a further-enlarged scale in a side view and in longitudinal section, FIG. 4 shows the detail according to FIG. 3 in a horizontal projection and in horizontal section, FIG. 5 shows a representation of the detail according to FIG. 4, with a changed relative position of the members, FIG. 6 shows an end view of a test or discharge member, FIG. 7 shows a diagrammatic representation of the apparatus for testing and separating out cigarettes, with (electrotechnical and pneumatic) control and actuation devices, in a diagrammatic side view, FIG. 8 shows a detail in the region of a cigarette magazine in a greatly enlarged view, and FIG. 9 shows a detail similar to that of FIG. 8 on the opposite side of the cigarette magazine.

FIG. 1 illustrates in simplified form the details of a cigarette packaging machine which are relevant here. The cigarettes 10 are located in a cigarette magazine 11 which is conventional and known for packaging machines of this type. Of this, the drawings only show shafts 12 extending in the lower region of the cigarette magazine. These are partitioned off from one another by thin shaft walls 13 sloping in the lower region, in such a way that the shafts 12 have an internal dimension which is slightly larger than the diameter of the cigarettes 10. These are received in the shafts 12 closely arranged on top of one another in rows 14.

In the present case, the cigarette magazine 11 is equipped with two shaft groups 15 and 16 which each serve for forming cigarette groups 17 assigned to a cigarette pack.

The cigarette groups 17 are formed by ejection of the cigarettes 10 belonging to them together from the lower region of the shafts 12 or shaft groups 15, 16. In the present exemplary embodiment, cigarette groups 17 with three layers 18, 19 and 20 are formed. At least the two outer layers 18 and 20 consist of a number of cigarettes 10 corresponding to the number of shafts 12 located next to one another. The cigarette group 17 is pushed out of the shafts 12 in the longitudinal direction of the cigarettes 10 by slide members 21 assigned to each shaft group 15, 16 and having a number of fingers 22 corresponding to the number of shafts 12. The height of the web-shaped thin-walled fingers 22 is such that three cigarettes 10 resting on top of one another in each row 14 are grasped and taken along.

The cigarette magazine or the shaft groups 15, 16 end in the lower region on bearing plates 23 and 24 which are arranged inclined towards one another according to the relative position (inclination) of the shafts 12 and which are directed transversely relative to the shaft walls 13. The bottom cigarette 10 of each row 14 of cigarettes rests on these bearing plates 23 and 24. On these bearing plates 23 and 24, the cigarettes 10 of the particular cigarette group 17 are conveyed from the shaft groups 15, 16 into pockets 25 of a cigarette turret 26 by the slide members 21. On the way from the shaft groups 15, 16 to the cigarette turret 26, the cigarettes of the middle layer 19 are shifted so that they assume the formation ready for packaging, as illustrated (saddle position). By means of the cigarette turret 26 rotating in steps about a (horizontal) axis, the cigarette groups 17 are conveyed into a lower plane and transported away here, in the present case by a chain conveyor 27, of which the engagement means 28 penetrating into the pocket 25 is shown in FIG. 1.

The shafts 12 are limited in the region of the ends of the cigarettes 10 by a front wall 29 and rear wall 30. These essentially vertical walls end at a distance above the bearing plates 23, 24, so that the slide members 21 can penetrate by means of their fingers 22 into the shafts 12. The shaft walls 13 extend up to the bearing plates 23, 24 and are anchored in these. The front wall 29 merges at a distance above the bearing plate 23 or 24 into an upper wall 31 which forms the top cover of a closed conveyor channel 32 for the cigarette group 17 between the shaft group 15 or 16 and the cigarette turret 26.

The cigarette turret 26 is driven by means of a shaft 33, the stepped rotary movements of which are produced by a stepping gear with a driver 34 and a star wheel 35.

The cigarettes 10 are tested for a proper filling of tobacco in the region of the cigarette magazine 11 or the shaft groups 15, 16. For this purpose, the front wall 29 on the one hand and the rear wall 30 on the other hand are provided with bores 36 and a recess 37 respectively.

In the present exemplary embodiment, a cigarette test member, specifically a test block 38, is arranged in the region of the front wall 29. This test block is equipped with a number of test plungers 39 corresponding to the number of cigarettes to be tested simultaneously. The test plungers 39 project from the test block 38, each pass through an associated bore 36 in the front wall 29 and each rest preferably centrally against the free end face of a cigarette, specifically on the "tobacco side" (as opposed to the "filter side"). The test plungers 39 are axially displaceable against elastic stress, so that when the cigarette 10 is properly filled they are displaced into the test block 38. However, if a cigarette lacks a sufficient filling, of tobacco, the particular test plunger 39 assigned to it penetrates into the cigarette 10 as a result of elastic pressure. An error or control signal resulting in the elimination of the particular defective cigarette is generated thereby as schematically illustrated in FIG. 7.

The test block 38 with the test plungers 39 can be designed in a suitable way, for example according to German patent specification No. 2,229,382. There, the individual test plungers are loaded by helical springs. Alternatively, the test plungers can also be actuated pneumatically or in any other elastic way.

In the present exemplary embodiment, to eliminate any defective cigarettes a separating member, in the present case a pull-off block 40, is arranged at each shaft group 15, 16 on the side located opposite the test block 38. This pull-off block is equipped with a number of grab members which each serve to remove a defective cigarette from the region of the particular shaft 12. In the present exemplary embodiment, these grab members consist of elongate needles 41 each with a point 42. To eliminate a (defective) cigarette, this point is inserted longitudinally, into the latter, in such a way that the cigarette 10 is fixed on the needle 41 as a result of friction. This effect is particularly pronounced when the needle 41 is inserted into a filter 43 of the cigarette. The pull-off block 40 is therefore arranged on the side of the cigarettes 10 having the filter 43. The point 42 of the needle 41 penetrates into the filter 43 via the free end or front face.

The pull-off block 40 is equipped with a number of needles 41, acting as grab members, corresponding to the number of cigarettes in a cigarette group 17. In the present case, these needles are arranged opposite the test plungers 39 of the test block 38, so that a needle 41 located directly opposite the test plunger 39 is assigned to a defective cigarette 10. In the initial position, the needles 41 project somewhat from the pull-off block 40 by means of their points 42 and are located in the common recess 37 in the rear wall 30.

A guide channel 44 is formed for each needle 41 in the pull-off block 40. The needles 41 are movable in the longitudinal direction in this guide channel. On the side located opposite the points 42, the guide channels 44 have a channel widening 45. Pistons 46 arranged at the ends of the needles 41 are movable in these. The axial movements are executed against elastic pressure, in the present case against the load of a restoring spring 47 mounted inside the channel widening 45.

The needles 41 are stressed longitudinally in a suitable way for insertion into a cigarette 10. In the present case, a compressed-air line 48 coming from a common compressed-air source is connected to each guide channel 44 or to a channel widening 45, specifically via a moulded piece 49. The compressed-air line 48 assigned to a defective cigarette is subjected to or released by the error signal, so that the associated needle 41 is subjected to compressed air via the piston 46 and displaced in the axial direction (see, for example, FIG. 5). As indicated in FIG. 7, test block 38 includes a transducer 55 which generates an error signal for each test plunger 39 which penetrates a defective cigarette (i.e. one which is insufficiently filled with tobacco). Any generated error signal is amplified by an amplifier 56 and applied to another transducer 57 which releases the corresponding compressed-air line 48 to actuate the corresponding piston 46 and its associated needle 41.

In the present case, to separate the defective cigarettes out of the cigarette formation or the shaft 12 after the needle 41 has been inserted in the particular cigarette, the entire pull-off block 40 is retracted from the pull-off position (FIGS. 1 and 5), that is to say from the position facing the cigarette magazine 11, in such a way that the cigarette is completely removed from the region of the shaft 12. FIGS. 3 and 4 illustrate an intermediate position during the relevant retracting movement of the pull-off block 40.

As soon as the separated cigarette is outside the region of the cigarette magazine 11, air is removed from the particular compressed-air line 48 assigned to it. Under the effect of the restoring spring 47, the needle 41 returns to the initial position (up against the end of the moulded piece 49). At the same time, the needle 41 disappears in the guide channel 40. The cigarette 10 is stripped off on the end face of the pull-off block 40. It can fall into a collecting vessel or onto a conveyor.

A further special feature is that, when a defective cigarette is detected, a number of cigarettes arranged on top of one another corresponding to the number of layers 18, 19, 20 is separated out from the particular shaft 12, that is to say, in the present exemplary embodiment, three cigarettes (FIG. 3). The reason for this is that, whenever appropriate cigarettes groups 17 are pushed out at the bottom end of the shafts 12, in each case three cigarettes slide down after them in the latter. To ensure that each cigarette is tested, it is necessary to maintain this number even when the cigarette is separated out.

Consequently, as shown in FIG. 3, every three grab members or needles 41 located above one another are coupled to one another operatively. In the case of pneumatic actuation, the three needles 41 located above one another or their guide channels 44 are connected to a common compressed-air line 48 via an appropriately shaped moulding 49.

The test and separating apparatus is arranged in the lowermost region of the shaft groups 15, 16, specifically at a distance of only two cigarettes from the lower cigarette group 17 to be pushed out of the cigarette magazine 11. In the lower region of the shafts 12, maximum orientation of the cigarettes and stabilisation of their positions within the shafts 12 are ensured.

In the exemplary embodiment illustrated, the movements of the pull-off block 40 are coupled to those of the slide members 21. In actual fact, the pull-off block 40 and slide member 21 are arranged on a common holder 50. This member is supported displaceably by means of its lower part, in particular by means of supporting rollers 51 and 52 arranged at an angle to one another, on fixed supporting and running rails 53 of trapezoidal cross-section. The holder 50 is made in the form of a hood. The inclined supporting rollers 51 and 52 are supported positively on correspondingly inclined running surfaces 54 of the supporting and running rail. The holder 50 is thereby secured equally against downward and upward movements and movements towards the sides. A to and fro movement is provided only in the longitudinal direction of the supporting and running rails 53.

The arrangement of the slide members 21 and of the pull-off blocks 40 on the common holder 50 is such that, in the end position of the fingers 22, when a cigarette group 17 is pushed out (FIG. 1), the pull-off blocks 40 are in the separating position, that is to say immediately adjacent to the rear wall 30. At the same time, the elongate fingers 22 extend up to the cigarette turret 26, so that the cigarette group 17 can be pushed fully into the pocket 25 kept ready.

According to a modified embodiment of the invention not illustrated in the drawings, the grab members for the defective cigarettes can also be designed as suction members, that is to say with heads which are subjected to suction air and which grasp the cigarette by means of suction on the end face of the filter 43 and/or on the outer substantially air-tight cylindrical surface of the latter, and pull it off.

The test and discharge members for the defective cigarettes in the design described can also be arranged at other locations in the packaging machine, for example additionally or alternatively in the region of the cigarette turret 26.

In the exemplary embodiment illustrated, the test apparatus, in particular the test block 38, and the device for eliminating the defective cigarettes, in particular the pull-off block 40, are arranged at the same height on mutually opposite sides of the shaft groups 15, 16. Alternatively, the abovementioned members can be arranged offset relative to one another in terms of height, particularly in such a way that the test block 38 is arranged in a plane above the pull-off block 40. The height offset appropriately corresponds to the number of cigarettes arranged on top of one another which are ejected from a shaft 12 simultaneously, that is to say, in the present exemplary embodiment, to a distance of three cigarettes. In this alternative solution, the following cigarettes are already being subjected to the test block 38 or to the test plunger 39 whereas the defective cigarettes detected during a preceding test are being drawn out of the structure by the pull-off block 40. It is thereby possible to overlap the test and separating operations in time and consequently speed them up.

We claim:

1. In a cigarette packaging machine having a cigarette magazine (11) containing shafts (12) for feeding and forming cigarette groups (17), each of said shafts having a front wall (29) and a rear wall (30), said apparatus comprising:

a plurality of test plungers (39) for engaging first ends of cigarettes in said cigarette group and for testing the tobacco content of the cigarettes said plungers (39) passing through bores (36) formed in said front wall;

a plurality of grab members (41) for grabbing defective cigarettes and withdrawing them from the feed flow, said grab members passing through a recess (37) formed in said rear wall (30);

a common holder (40), mounted on said packaging machine, for holding said grab members;

a plurality of channel-shaped guides (44), mounted on said packaging machine, each guide containing one of said grab members;

actuating means (48) for selectively actuating said grab members (41) to grab selected cigarettes of said cigarette group (17); and drive means, coupled to said common holder, for retracting said common holder (40) to withdraw the grabbed cigarettes from said cigarette group.

2. Apparatus according to claim 1 wherein each of said grab members is a needle (41) which penetrates the other end of a grabbed cigarette and adheres thereto by friction for withdrawing the cigarette.

3. Apparatus according to claim 2 further comprising pressure-exerting means for displaceing each needle (41) out of its associated guide (44) so that the needle point (42) is pushed out the guide and into the opposite end of a cigarette.

4. Apparatus according to claim 3 wherein each channel has a widened portion (45), and wherein said pressure-exerting means comprises a piston (46) engaging the end of the needle (41) opposite said point (42), and means for applying compresssed air to said widened portion to displace said piston and push said needle (41) out of the guide (44).

5. Apparatus according to claim 3 further comprising restoring spring means (47) in each guide for urging a needle into a retracted position within the guide.

6. Apparatus according to claim 2 wherein the number of needles (41) held by said common holder (40) and the number of said plungers (39) are equal to each other, and wherein said number is equal to the number of cigarettes in said cigarette group (17).

7. Apparatus according to claim 6 further comprising a test block (38) for holding said test plungers (39), said test block (38) and said common holder (40) being disposed on opposite sides of said shaft (12), and control means, coupled between said test block (38) and said drive means, for retracting said common holder (40) and withdrawing the defective cigarettes detected by said test plungers (39).

8. Apparatus according to claim 7 comprising means for moving said test block (38) so that all of said test plungers (39) simultaneously move into contact with said first ends of the cigarettes in said cigarette group (17).

9. Apparatus according to claim 8 wherein a cigarette group (17) consists of three layers of cigarettes forming columns of three cigarettes, and further comprising conveying means located below the shaft (12), and finger means (22) for pushing a tested cigarette group onto said conveyor means, said test block (38) and said common block (40) being disposed above said cigarette group at a distance equal to the diameter of two cigarettes.

10. Apparatus according to claim 9 further comprising means intercoupling three of said needles (41) so that, when said test pungers (39) detect a defective cigarette in one of said columns of three cigarettes, the intercoupled needles simultaneously grab and withdraw all three cigarettes in said column.

11. Apparatus according to claim 9 comprising holder means (50) for rigidly interconnecting said finger means (22, 21) and said common holder (40) so that said common holder (40) and said finger means (22, 21) are moved together to withdraw cigarettes and to push a tested cigarette group onto said conveyor means, respectively.

12. Apparatus according to claim 1 wherein said grab members are suction holders.

* * * * *